United States Patent [19]

Hugues et al.

[11] Patent Number: 4,882,025

[45] Date of Patent: Nov. 21, 1989

[54] PVC WOVEN DIAPHRAGM FOR THE ELECTROLYSIS OF HYDROCHLORIC ACID

[75] Inventors: Patrice Hugues, Marcq en Baroeuil; Jean-Maurice Perineau, Villiers sur Marne, both of France

[73] Assignee: Rhone-Poulenc Chimie, Courbevoie, France

[21] Appl. No.: 216,334

[22] Filed: Jul. 8, 1988

[30] Foreign Application Priority Data

Jul. 9, 1987 [FR] France ..... 8710094

[51] Int. Cl.[4] ..... C25B 9/00; C25B 13/08

[52] U.S. Cl. ..... 204/252; 204/296; 264/103; 264/230; 264/234; 264/345; 428/257; 28/167; 139/420 A

[58] Field of Search ..... 264/103, 234, 230, 345; 204/296, 252, 295; 428/257; 210/500.1, 500.27; 139/420 A; 432/8; 28/165, 167

[56] References Cited

U.S. PATENT DOCUMENTS 4,259,394 3/1981 Khan ..... 428/257

4,539,082 9/1985 Klotz et al. ..... 204/295

FOREIGN PATENT DOCUMENTS 1508922 1/1967 France .

1176649 2/1970 United Kingdom .

*Primary Examiner*—John F. Niebling

*Assistant Examiner*—Kathryn Gorgos

*Attorney, Agent, or Firm*—Burns, Doane, Swecker & Mathis

[57] ABSTRACT

Heat-set woven diaphragms based on polyvinyl chloride, well adapted for the electrolysis of hydrochloric acid, comprise:

(a) a combination of warp threads and weft threads woven into a cloth weave and having a number of crossings per square centimeter ranging from 270 to 350;

(b) warp threads and the weft threads which comprise a mixture of atactic polyvinyl chloride and superchlorinated polyvinyl chloride;

(c) an average thickness of from 0.5 to 0.7 mm; and (d) high creasing resistance.

15 Claims, No Drawings

PVC WOVEN DIAPHRAGM FOR THE ELECTROLYSIS OF HYDROCHLORIC ACID

BACKGROUND OF THE INVENTION

1. Field of the Invention

The present invention relates to woven diaphragms and, more especially, to woven diaphragms that are particularly well adapted for the electrolysis of hydrochloric acid.

2. Description of the Prior Art

Electrolysis of hydrochloric acid is a well-known process (cf., for example, *Proceedings of the Electrochemical Society,* Vol. 84, 11 (1984), pages 259 et seq.), particularly for producing gaseous chlorine. Plants exist in the majority of industrial nations as means for making valuable use of hydrochloric acid generated by absorption of gaseous hydrogen chloride with water, the gaseous hydrogen chloride being an unavoidable by-product of many organic and inorganic chemical syntheses.

In this process, the electrolysis cells consist of an assembly of the filter-press type; the anode and cathode compartments are separated by a diaphragm, made of polyvinyl chloride in most cases, to avoid mixing of the chlorine and hydrogen produced.

While, in general, the electrolyzer operates satisfactorily, operation of the cell must nevertheless frequently be ceased as a result of the excessive flow of the gases from one compartment into the other, leading to the formation of an explosive mixture of chlorine and hydrogen.

As is apparent from U.S. Pat. No. 3,855,104, the weak point of these electrolyzers is the diaphragm, which is a cloth made of polyvinyl chloride. While these materials are considered to be the most suitable for this purpose, they present many disadvantages in use, among which there may be mentioned:

(i) their embrittlement by chlorination within the electrolysis cell;

(ii) their pronounced tendency to tear and become perforated, particularly along the horizontal folds which are formed when the electrolyzer is in operation; and (iii) their lack of mechanical strength.

These disadvantages result in premature wear of the diaphragms, which are then incapable of fulfilling their separating function. Not only can the purity of the gases produced no longer be ensured, but mixing thereof can reach a limit which is unacceptable for safety reasons. Furthermore, the flow of chlorine into the cathode compartment leads to an increase in the energy consumption.

SUMMARY OF THE INVENTION

Accordingly, a major object of the present invention is the provision of improved woven diaphragms based on polyvinyl chloride which conspicuously avoid those disadvantages and drawbacks to date characterizing the state of this art.

Another object of this invention is the provision of novel diaphragms which exhibit the lowest possible drop in electrical resistance.

Briefly, the present invention features a woven diaphragm based on polyvinyl chloride, comprising:

(a) a combination of warp threads and weft threads woven in a cloth weave with a number of crossings per square centimeter which ranges from 270 to 350;

(b) warp threads and the weft threads which comprise a mixture of atactic polyvinyl chloride and superchlorinated polyvinyl chloride;

(c) an average thickness of from 0.5 to 0.7 mm; and (d) high creasing resistance.

DETAILED DESCRIPTION OF THE PREFERRED EMBODIMENTS OF THE INVENTION

More particularly according to the present invention, the subject diaphragms advantageously have an air permeability of from 5 to 30 $l/m^2/s$, measured under 20 mm of a head of water.

Moreover, the diaphragms according to the invention advantageously have a water permeability greater than 2 min, measured as the time required for 800 $cm^3$ of water at a temperature of 22° C., + or −2° C., to flow under gravity through 75 $cm^2$ of the diaphragm, flat and arranged horizontally.

This permeability preferably ranges from 3 to 10 min.

The true electrolyte coefficient exhibited by the diaphragms according to the invention and measured at 20° C. in an aqueous solution of hydrochloric acid containing 6 moles per liter, or the relationship between the resistance of a volume of the diaphragm impregnated with the electrolyte and the resistance of this same volume of electrolyte ($R/R_o$), ranges from 6 to 40 and, preferably, from 8 to 18.

The diaphragms according to the invention have warp threads and weft threads which are a mixture of atactic polyvinyl chloride (PVC) and superchlorinated polyvinyl chloride.

By "superchlorinated PVC" are intended chlorinated polyvinyl chloride polymers, per se known to this art, which may be prepared by chlorination of a suspension of polyvinyl chloride in the presence of actinic light, by high-temperature chlorination, by chlorination in the presence of chemically active radiations, or by any other process which enable production of a polymer characterized by a second-order transition temperature of at least 100° C. and, in particular, such polymers which, in addition, exhibit a chlorine content of more than 66%.

By "atactic PVC" are intended polyvinyl chloride polymers prepared by the most widely used polymerization processes, which are thermoplastic materials exhibiting a softening point in the region of 70° C., and which have a large proportion of chlorine atoms arranged randomly on the main polymer chain.

Examples of such polyvinyl chloride polymers and superchlorinated polyvinyl chloride polymers are contained in French Patent No. 1,359,178 and its first Certificate of Addition thereto, P.V. No. 961,027, both hereby incorporated by reference.

And by "mixture" are intended filaments, threads, fibers and similar articles obtained by spinning from solutions or from suspensions in a liquid medium or by any other method of spinning from a mixture of at least one polymer of each of the aforesaid two categories, the spinning being followed by drawing by any suitable means and then by a retraction in boiling water (cf. the above-mentioned French Patent and the Addition thereto).

The proportion of superchlorinated PVC introduced into the mixture of atactic PVC and of superchlorinated PVC is generally greater than 10% by weight, while remaining below 80%. When the superchlorinated PVC employed has a chlorine content above 66%, it advantageously constitutes from 10 to 30% by weight of the above-mentioned mixture.

By way of example of mixtures of atactic PVC and of superchlorinated PVC which are suitable for the preparation of the diaphragms according to the invention, there may be mentioned Thermovy ® ZC, marketed by Rhovyl S.A..

Obviously, the mixture whose essential constituents are as indicated above may contain a minor amount, generally not exceeding 10% by weight, of the mixture of another "fiber-forming" polymer such as polytetrafluoroethylene or any other member of the class of fluorinated polymers which are well known to this art.

These mixtures are used to produce threads whose degree of retraction, measured at 110° C. in dry air, is on the order of 9% (or less).

The number of crossings or intersections in the cloth weave constitutes one of the essential characteristics of the diaphragms according to the invention. In fact, when this is less than 270 per square centimeter, the fabric is too permeable and, when such fabric is used as a diaphragm in the electrolysis of hydrochloric acid, the flow of chlorine into the hydrogen is prohibitive. On the other hand, when it is more than 350, the drop in electrical resistance becomes too high.

The number of crossings per square centimeter advantageously ranges from 300 to 340.

The average thickness of the diaphragm advantageously ranges from 0.5 to 0.7 mm.

If the thickness is less than 0.5 mm, the mechanical strength of the fabric is unsatisfactory.

The thickness is advantageously less than 0.7 mm, to limit the bulk and the electrical resistance.

As indicated above, the diaphragms according to the invention advantageously have an air permeability of from 5 to 30 $l/m^2/s$, measured under 20 mm of a head of water. The measurement is carried out according to the protocol described in AFNOR standard G 07-111 dated April 1973.

Furthermore, these diaphragms may also exhibit a water permeability of more than 2 min and, preferably, of from 3 to 10 min. The method of measurement of this permeability consists essentially in determining the time required for 800$cm^3$ of water, at a temperature of 22° C. (within + or −2° C.) to flow under gravity through 75 $cm^2$ of the diaphragm, flat and arranged horizontally.

The diaphragms according to this invention also exhibit a high creasing resistance; this creasing resistance of the product which has been heat-set (within the meaning given hereinafter) may be defined by a folding test as follows:

a sample of cloth (2×6 cm) is folded in two by pressure between the thumb and the index finger, and the fold is marked by being tightly squeezed. When it is released, the sample retains the fold mark and retains a "V" shape. If the angle is greater than 90°, the product has been heat-set; if the angle remains acute, the product has not been heat-set.

The diaphragms of this invention advantageously have 23 warp threads (to within + or −0.5 threads) per centimeter and from 13.5 to 15 weft threads (to within + or −0.5 threads) per centimeter.

The process for the production of said diaphragms according to the present invention comprises:

(i) weaving a set of warp threads and a set of weft threads in a cloth weave with a number of crossings per square centimeter of from 255 to 350, the warp threads and the weft threads being a metric number 20 yarn of two twisted strands of a mixture of atactic polyvinyl chloride and of superchlorinated polyvinyl chloride and exhibiting a degree of retraction of less than or equal to 9%, measured at 110° C. in dry air, followed by (ii) heat-setting of the cloth in a dry atmosphere at a temperature of from 110° to 120° C.

In the weave pattern of the cloth which has not been heat-set, the number of crossings per square centimeter is slightly lower than that given for the heat-set fabric, to take account of the fact that the heat-setting constituting stage (ii) of the process causes an additional tightening of the cloth.

The weaving is advantageously carried out with a number of warp threads per centimeter which is 23 (to within +or−0.5) and a number of weft threads per centimeter of from 12.5 to 15 (to within + or −0.5).

The warp threads, like the weft threads, are in the form of metric number 20 yarn of two twisted strands, the twisting ensuring, on the one hand, good processing during the weaving and, on the other hand, a control of the permeability of the final fabric.

The twist generally ranges from 430 to 470 T/m and preferably from 440 to 460 T/m.

The heat-setting of the cloth is carried out in dry atmosphere at a temperature of from 110° to 120° C.

By a "dry atmosphere" is intended an open or closed atmosphere whose water or liquid content is maintained as low as possible, bearing in mind the constraints which are usually encountered in industry.

This atmosphere is advantageously that of a hot air oven or of a gas oven.

The precise temperature at which this operation should be conducted is dictated by the nature of the fibers and ranges from 110° to 120° C.

The residence time at the selected temperature is generally longer than 1 min and shorter than 10 min. It is preferably less than 5 min.

In order to further illustrate the present invention and the advantages thereof, the following specific examples are given, it being understood that same are intended only as illustrative and in nowise limitative.

EXAMPLES 7 diaphragms (Examples 1 to 7) were produced by weaving a set of warp threads and a set of weft threads, into a cloth weave, both sets of threads being a metric number 20 yarn of two strands twisted at 450 T/m made of Thermovy ® ZC (chlorofibers marketed by Rhovyl S.A.) and then by maintaining the fabric for a time (t) at the temperature of 115° C. (unless indicated otherwise) in an oven, the cloth being, where appropriate, stretched between clamps on its two selvages.

A diaphragm (control test a) was also produced by weaving a set of warp threads and a set of weft threads into a cloth weave, both sets of threads being a yarn similar to that produced in Examples 1 to 7, except that it was made of Fibravy ® LX (chlorofibers marketed by Rhovyl S.A., which was not subjected to retraction in boiling water after drawing and which had a degree of retraction of 55% at 100° C. in boiling water).

This fabric was then maintained stretched at 115° C. in an oven for 1.25 min.

The 8 diaphragms produced in this manner were employed in a set of cells for the electrolysis of hydrochloric acid. The electrodes were made of grooved graphite. The operating conditions were as follows:

| | |
|---|---|
| Temperature | 70° C. |
| Hydrochloric acid concentration | 20% |
| Interpolar distance | 7 mm |
| Groove depth | 10 mm |

The gases were analyzed on exiting the electrolyzer by means of gas phase chromatography.

The individual conditions, the characteristics of the diaphragms employed and the results obtained are reported in the Table below, in which:

A: represents the number of warp threads per centimeter and the number of weft threads per centimeter in the heat-set fabric.

Water permeability is expressed in min, air permeability in $l/m^2/s$; they were measured as indicated hereinbefore.

$R/R_o$: the relationship between the resistance of a volume of the diaphragm impregnated with the electrolyte and the resistance of this same volume of electrolyte.

$(Cl_2)$ %:denotes the percentage of chlorine in the hydrogen.

U: denotes the electrolyzer voltage expressed in volts per element under 12 kA (including the electrical resistance drop in the structures).

After 3 hours of operation, a combustion of the cloths in the control test (a) was observed.

TABLE

| Example No. | t min | fabric held | A | Permeability to water | Permeability to air | $R/R_o$ | $(Cl_2)$ % | U |
|---|---|---|---|---|---|---|---|---|
| 1 | 1.25 | stretched | 23 × 14 | ≃3.5 | 20 | 8 | 4.5 | 2.1 |
| 2 | (*) | stretched | 23 × 13 | 2.5 | 24 | 11 | 5 | 2.1 |
| 3 | 1.25 | free | 23 × 14 | 5.0 | 18 | 25 | 3.5 | 2.35 |
| 4 | 1.25 | stretched | 23 × 14.5 | 2.5 | 20 | N.D. | 5 | N.D. |
| 5 | 1.25 | free | 23 × 14.5 | 8.0 | 15 | 28 | 3 | 2.40 |
| 6 | 1.36 | free | 23.5 × 14 | ≃4.5 | 10 | 10 | 2.5 | 2.10 |
| 7 | 1.50 | free | 23.5 × 14 | ≃5.5 | 8 | 18 | 2 | 2.20 |
| control a | 1.25 | stretched | 23 × 14 | 15 | 18 | 60 | 3 | 3.6 |

(*): 10 seconds at 90°
N.D.: not determined

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A heat-set woven diaphragm based on polyvinyl chloride and adapted for the electrolysis of hydrochloric acid, comprising:

(a) a combination of warp threads and weft threads woven into a cloth weave with a number of crossings per square centimeter ranging from 270 to 350;

(b) warp threads and weft threads which comprise a mixture of atactic polyvinyl chloride and superchlorinated polyvinyl chloride;

(c) an average thickness ranging from 0.5 to 0.7 mm; and (d) high creasing resistance.

2. The woven diaphragm as defined by claim 1, having an air permeability of from 5 to 30 $l/m^2/s$, measured under 20 mm of a head of water.

3. The woven diaphragm as defined by claim 2, having a water permeability greater than 2 min, measured as the time required for 800 $cm^3$ of water at a temperature of 22° C.±2° C. to flow under gravity through 75 $cm^2$ of the diaphragm, flat and arranged horizontally.

4. The woven diaphragm as defined by claim 3, having a water permeability of from 3 to 10 min, measured as the time required for 800 $cm^3$ of water at a temperature of 22° C.±2° C. to flow under gravity through 75 $cm^2$ of the diaphragm, flat and arranged horizontally.

5. The woven diaphragm as defined by claim 3, having a number of crossings per square centimeter of from 310 to 340 in the cloth weave.

6. The woven diaphragm as defined by claim 1, having 23±0.5 wrap threads per centimeter and from 13.5 to 15 ±0.5 weft threads per centimeter.

7. The woven diaphragm as defined by claim 1, having a true electrolyte coefficient of from 6 to 40, measured at 20° C. in an aqueous solution of hydrochloric acid containing 6 moles per liter.

8. The woven diaphragm as defined by claim 7, having a true electrolyte coefficient of from 8 to 18, measured at 20° C. in an aqueous solution of hydrochloric acid containing 6 moles per liter.

9. A process for the production of the woven diaphragm as defined by claim 1, comprising:

(i) weaving a set of warp threads and a set of weft threads into a cloth weave with a number of crossings per square centimeter of from 255 to 350, the warp threads and the weft threads which comprise a metric number 20 yarn of two twisted strands, of a mixture of atactic polyvinyl chloride and superchlorinated polyvinyl chloride and exhibiting a degree of retraction of less than or equal to 9%, measured at 110° C. in dry air; and thence (ii) heat-setting the cloth in a dry atmosphere at a temperature of from 110° to 120° C.

10. The process as defined by claim 9, wherein the number of crossings per square centimeter in said cloth weave ranges from 295 to 340.

11. The process as defined by claim 9, wherein the number of warp threads per centimeter is 23 ±0.5 and the number of weft threads per centimeter ranges from 12.5 to 15 ±0.5.

12. The process as defined by claim 9, wherein the heat-setting of the cloth is conducted in a hot air oven, and the time of exposure of the fabric to the heat-setting temperature is longer than 1 min.

13. In an electrolytic cell for the electrolysis of hydrochloric acid, the improvement which comprises, as the diaphragm therefor, the woven diaphragm as defined by claim 1.

14. The woven diaphragm of claim 1 wherein the warp threads are twisted threads with a twist from 430 to 470 T/m.

15. The woven diaphragm of claim 1 wherein the weft threads are twisted with a twist from 430 to 470 T/m.

* * * * *